US006267666B1

(12) United States Patent
Wilhelmi

(10) Patent No.: US 6,267,666 B1
(45) Date of Patent: Jul. 31, 2001

(54) ROOM AIR CONDITIONING METHOD AND AN AIR-CONDITIONED CEILING FOR A METHOD OF THIS TYPE

(75) Inventor: Frank H. Wilhelmi, Frankfurt am Main (DE)

(73) Assignee: Wilhelmi Werke AG, Lahnau (DE)

( * ) Notice: Subject to any disclaimer, the term of this patent is extended or adjusted under 35 U.S.C. 154(b) by 0 days.

(21) Appl. No.: 09/462,847

(22) PCT Filed: May 13, 1998

(86) PCT No.: PCT/EP98/02813

§ 371 Date: Jan. 13, 2000

§ 102(e) Date: Jan. 13, 2000

(87) PCT Pub. No.: WO99/04111

PCT Pub. Date: Jan. 28, 1999

(30) Foreign Application Priority Data

Jul. 15, 1997 (DE) ..... 197 30 180

(51) Int. Cl.[7] ..... F24F 7/00
(52) U.S. Cl. ..... 454/292; 454/296
(58) Field of Search ..... 454/187, 270, 454/338, 296, 292

(56) References Cited

U.S. PATENT DOCUMENTS

| | | | | |
|---|---|---|---|---|
| 2,221,001 | | 11/1940 | Lucius . | |
| 2,291,220 | | 7/1942 | Germonprez . | |
| 3,570,385 | * | 3/1971 | Heisterkamp | 454/187 |
| 4,487,794 | | 12/1984 | Brown . | |
| 4,554,766 | * | 11/1985 | Ziemer et al. | 52/28 |
| 5,248,278 | * | 9/1993 | Fuerst et al. | 454/129 |

FOREIGN PATENT DOCUMENTS

| | | | | |
|---|---|---|---|---|
| 2426946 | * | 12/1975 | (DE) | 454/137 |
| 3240842 A1 | | 5/1984 | (DE) . | |
| 35339063 | * | 5/1987 | (DE) | 454/137 |
| 0 399 935 | | 11/1990 | (EP) . | |
| 0 756 138 A2 | | 1/1997 | (EP) . | |
| 900 896 | | 7/1962 | (GB) . | |
| 8502079 | | 7/1985 | (NL) . | |

OTHER PUBLICATIONS

Verdraengngsstroemung—Dr. Franz Sodec, Aachen TAB 7/90 pp. 579, 580, 581, 582, and 584.

* cited by examiner

*Primary Examiner*—Harold Joyce
*Assistant Examiner*—Derek S. Boles
(74) *Attorney, Agent, or Firm*—Flynn, Thiel, Boutell & Tanis, P.C.

(57) ABSTRACT

A single flow of incoming air through a closed sound-absorbent air-conditioned ceiling is used for air conditioning a room. The flow of incoming air can be temperature controlled. Part of the flow of heat associated with the flow of incoming air is conveyed into the room in the form of heat radiation emitted from the air-conditioned ceiling. The air-conditioned ceiling is manufactured from materials with a high level of heat conductivity for this purpose.

13 Claims, 1 Drawing Sheet

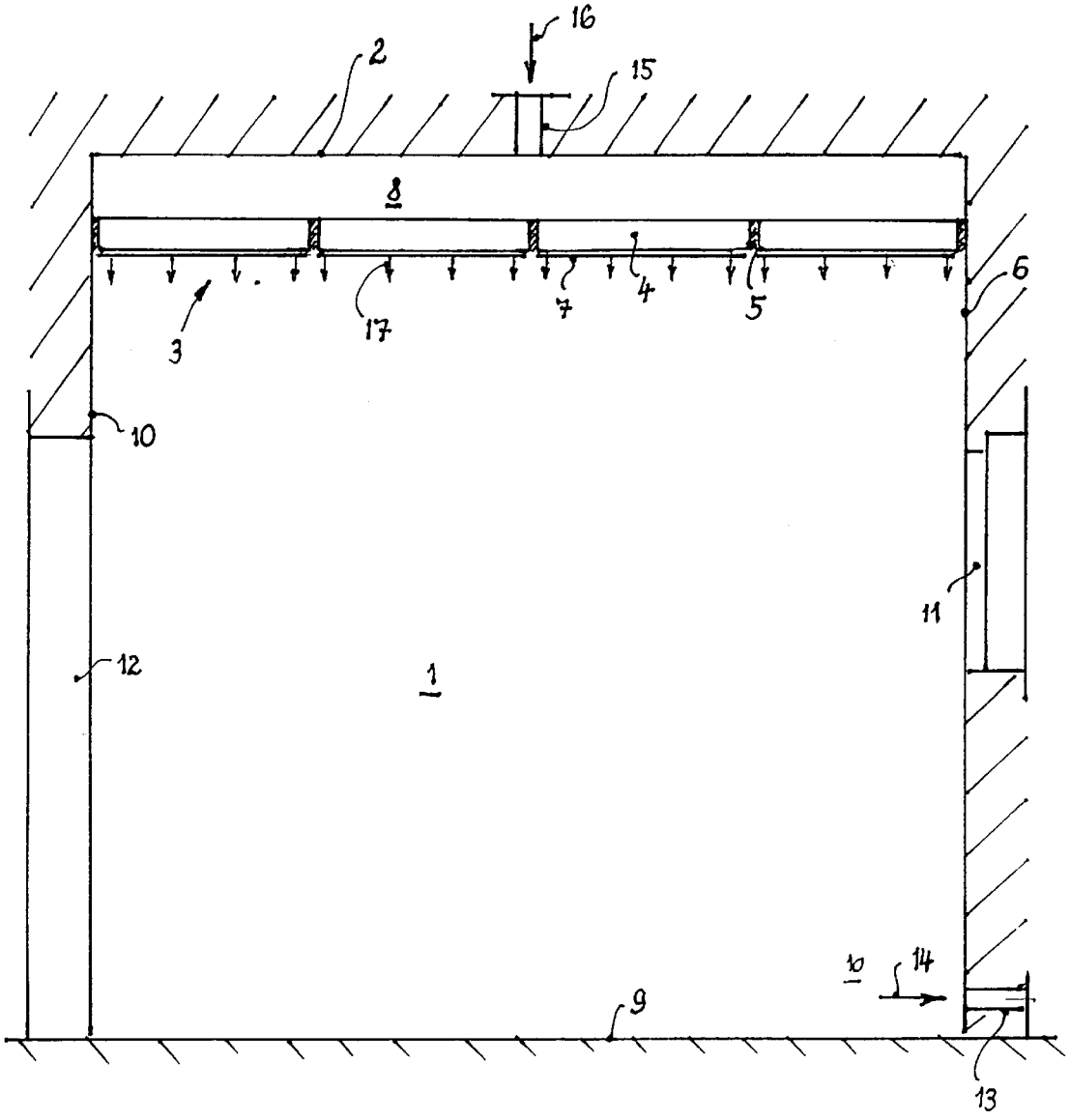
16
2
15
8
6
3
17
7
4
5
10
11
12
1
10
14
9
13

ROOM AIR CONDITIONING METHOD AND AN AIR-CONDITIONED CEILING FOR A METHOD OF THIS TYPE

FIELD OF THE INVENTION

The invention relates to a method for air-conditioning a room by means of an air-conditioned ceiling made of acoustic tiles arranged to be spaced from the room ceiling, which acoustic tiles or panels consist of an air-permeable material having a porous cover.

BACKGROUND OF THE INVENTION

Patent Application EP 0 756 138 A2 discloses a known flat cooling and heating element, which is used to construct an air-conditioned ceiling. Above the air-conditioned ceiling a partial flow of supply air is produced and passes through the porous acoustic tiles of the air-conditioned ceiling and into the room therebelow. A further partial flow of outside air is sucked in and is blown directly into the room through a wall of the room. It is therefore not necessary to hermetically seal off the space above the air-conditioned ceiling against the room therebelow, especially since the partial flow through the air-conditioned ceiling can also be supplemented by a further partial flow, which reaches into the room through a larger opening in the air-conditioned ceiling without a significant drop in pressure. Temperature control of the room occurs essentially through convection and requires a considerable control input.

Patent Application NL 8502079 A also discloses a known closed intermediate ceiling suspended in a room, which divides a cavity created at the ceiling of the room, through which cavity supply air is fed through the intermediate ceiling. The spent air is sucked out of the room through outlets in the floor. Temperature control of the room is, however, not intended, and the intermediate ceiling also does not consist of acoustic tiles, which would act in a noise absorbing and heat conducting manner, so that the supplementary provision of a heat exchanger cannot result in a satisfactory room temperature and sound absorption.

The purpose of the invention is therefore to design a method for air-conditioning a room by means of an air-conditioned ceiling so that little input is required for temperature control and regulation. Thus, the method for air-conditioning creates a comfortable, draft-free room climate, and maintains thereby the advantages of a sound-absorbing and heat-conducting design.

SUMMARY OF THE INVENTION

The purpose is attained according to the invention by arranging the acoustic tiles such that between the air-conditioned ceiling and the room ceiling there is created a cavity, which is flow-connected to the room through the air-conditioned ceiling and is otherwise sealed off against the room. The supply air is fed completely or at least predominantly through the air-conditioned ceiling to the room. Furthermore the cavity is charged with temperature controlled air and its air pressure is chosen such that a laminar air flow is produced through the acoustic tiles and toward the room without a draft occurring in the room. Furthermore the material of the acoustic tile and its cover are chosen such that a portion of the heat radiation in the heat transported into the room through the acoustic tiles, that occurs as heat radiation lies between 20 and 80%. Finally the spent air is discharged from an area of the room which is spaced from the air-conditioned ceiling and/or is partitioned off against the heat radiation coming from the ceiling.

There is no danger that a room air-conditioned in this manner would experience drafts or fall below the condensation point due to directly introduced outside air. On the other hand, a discharge of the air in the room which is protected against the heat radiation, can take care of a continuous air heat exchange without significant heat loss. It is very important that the supply air prior to its entry into the room enters into a heat exchange with the acoustic tiles so that said tiles emit a heat radiation and the room can be temperature controlled within a short period of time. Such an effect can be achieved in a simple manner with an air-conditioned ceiling, in which the material and the construction of the acoustic tiles and their cover are chosen with a high heat-transfer coefficient and in such a manner that the portion of the heat radiation transported into the room lies between 20 and 80% and the room can be temperature controlled within a short period of time.

It is advantageous when the air pressure and the acoustic tiles are chosen such that between the cavity and the room there occurs a pressure difference of at most 20 Pa. This guarantees that on the one hand a sufficient air-exchange number is achieved without, on the other hand, drafts occurring. Thus turbulences directly on the air-conditioned ceiling can be avoided when the laminar air flow exits the air-conditioned ceiling at a speed of at most 0.1 m/s. The air flow in the room itself is not supposed to exceed 0.25 m/s.

As a whole, such an air-conditioned ceiling meets high demands with regard to comfort and health for the air-conditioned room while placing minor requirements on the structural input and the maintenance of the system. Thus the cavity is free of components and the room air falling below the condensation point due to a supply of outside air is not to be feared. The method creates an arrangement, in which the tasks of an air-conditioned ceiling and of an air-circulating system are realized at the same time so that the manufacture and the installation can occur extremely economically.

BRIEF DESCRIPTION OF THE DRAWING

The invention will be discussed in greater detail hereinafter using one exemplary embodiment and the drawing. The single FIGURE illustrates a schematic cross-sectional view of a room with air-conditioning operating according to the method of the invention.

DETAILED DESCRIPTION OF THE INVENTION

An air-conditioned ceiling 3 is suspended in a suitable technically common manner, not indicated here in detail, in a room 1 to be air conditioned and spaced from its ceiling 2. The air-conditioned ceiling 3 consists of individual, porous acoustic tiles or panels 4, which abut one another and the surrounding walls 6 of the room with narrow and sealed-off butt joints 5. The acoustic tiles 4 are each covered with a cover 7 at least on their sides facing the room 1. The cover 7 is also porous so that acoustic waves can penetrate into the acoustic tiles 4 and can be absorbed therein. Consequently a cavity 8 is formed between the air-conditioned ceiling 3 and the ceiling 2 of the room and is divided from the room 1.

Openings comprising one window 11 and one door 12 are symbolically indicated in the room 1 having walls 6. The room 1 is erected above a room floor 9. The openings can, also in the closed state, be utilized for the exchange of the air in the room 1. At least one opening 13 can moreover be provided for the spent air 14 in a special arrangement, which will be described later on.

The cavity 8 is connected through at least one opening 15 to an air pressure source, that provides the necessary supply air 16, which is flushed into the room 1 through the acoustic tiles 4 and their cover 7 as a homogeneous laminar air flow 17. The pressure difference through the air-conditioned ceiling 3 is at a maximum of 20 Pa and is chosen such that the air flow 17 exits from the covers 7 at most with 0.1 m/s.

The heat flow connected to the air flow 17 remains only partially coupled to the air flow 17. Because of the special design of the acoustic tiles 4 and their cover 7, each made of a material with a high heat conductivity, a portion of the heat flow is divided from the air flow and is emitted through the acoustic tiles 4 and their covers 7 partially through heat transfer, mostly, however, through (inertialess) heat radiation into the room 1, which in this manner can be quickly temperature controlled. The opening 13 for the spent air 14 is therefore installed farther removed from the air-conditioned ceiling 3. If necessary, the area 10 of the room with the opening 13 is shielded against the heat radiation exiting from the air-conditioned ceiling 3. Although a particular preferred embodiment of the invention has been disclosed in detail for illustrative purposes, it will be recognized that variations or modifications of the disclosed apparatus, including the rearrangement of parts, lie within the scope of the present invitation.

What is claimed is:

1. A method for air-conditioning a room by means of an air-conditioned ceiling made with acoustic panels arranged spaced from the room ceiling, said acoustic panels comprising an air-permeable material having a porous cover, wherein:

(a) the acoustic panels are arranged such that a cavity is created between the air-conditioned ceiling and the ceiling of the room, which cavity is flow-connected to the room through the acoustic panels and is otherwise sealed off from the room, (b) supply air is fed completely or at least predominately through the acoustic panels to the room, (c) the cavity is charged with temperature controlled air and air pressure in the cavity is chosen such that a laminar air flow is produced through the acoustic panels and toward the room without a draft occurring in the room, (d) the material of the acoustic panel and said porous cover are chosen such that heat radiation in the heat transported into the room lies between 20% and 80% of the heat being transported through said acoustic panel, and (e) spent air is discharged from an area of the room, the area being spaced from the air-conditioned ceiling and/or partitioned off from the heat radiation coming from said ceiling.

2. The method according to claim 1, wherein the porous cover is applied to the back and/or front side of the air-permeable material.

3. The method according to claim 1, wherein the pressure of the air and the acoustic tiles are chosen in such a manner that a pressure difference of at most 20 Pa occurs between the cavity and the room.

4. The method according to claim 1, wherein the laminar air flow exits the air-conditioned ceiling at most at 0.1 m/s.

5. The method according to claim 1, wherein the air flow into the room does not exceed 0.25 m/s.

6. An air-conditioned ceiling for air-conditioning a room comprising:

acoustic tiles arranged spaced from the room ceiling, said acoustic tiles comprising an air-permeable material having a porous cover, said acoustic tiles being arranged to create a cavity between said tiles and the ceiling of the room, the cavity being flow-connected to the room through said acoustic tiles and otherwise sealed off from the room, wherein the air-permeable material and the construction the acoustic tiles and said porous cover are chosen with a high heat-transfer coefficient so that heat radiation in the heat transported into the room lies between 20% and 80% of the heat transported into the room;

air supply means for supplying air to the cavity and through said acoustic tiles into the room, said air supply means providing the cavity with an air pressure such that a laminar air flow is produced through said acoustic tiles without a draft occurring in the room; and an opening in the room for receiving spent air and enabling the spent air to exit from the room.

7. An air-conditioned ceiling system for air-conditioning a room comprising:

acoustic panels arranged spaced from the room ceiling, said acoustic panels comprising an air-permeable material having a porous cover, said acoustic panels being arranged to create a cavity between said panels and the ceiling of the room, the cavity being flow-connected to the room through said acoustic panels and otherwise substantially sealed off from the room, a top side of the acoustic panels being in surface relationship with the cavity extending to the ceiling;

butt joints supporting said acoustic panels to form the air-conditioned ceiling;

air supply means for supplying air to the cavity and then through said acoustic panels into the room, said air supply means providing the cavity with an air pressure such that a laminar air flow is produced through said acoustic panels without a draft occurring in the room; and an opening in the room for receiving spent air, and enabling the spent air to exit from the room.

8. The system of claim 7, wherein said air supply means supplies air so that a pressure difference of at most 20 Pa occurs between the cavity and the room, and the air flow into the room does not exceed 0.25 m/sec.

9. The system of claim 7, wherein the air-permeable material and said porous cover of said acoustic panels are selected with a high heat-transfer coefficient so that heat radiation in the heat transported into the room lies between 20% and 80% of the heat transported into the room.

10. The system of claim 7, wherein no elements are mounted onto said acoustic panels.

11. The system of claim 7, wherein said acoustic panels enable the laminar air flow from the cavity through substantially the entire surface area of the top side and substantially the entire surface area of a bottom side of said acoustic panels to the room.

12. The system of claim 7, wherein the acoustic panels only consist of the air-permeable material and said porous cover.

13. The system of claim 7, wherein the air-permeable material of said acoustic panels is structured so that the air flow through the air-conditioned ceiling is at most 0.1 m/sec.

* * * * *